US006720498B2

(12) United States Patent
Grögl et al.

(10) Patent No.: US 6,720,498 B2
(45) Date of Patent: Apr. 13, 2004

(54) ELECTRICAL LINE

(75) Inventors: Ferdinand Grögl, Nuremberg (DE); Uwe Marx, Postbauer-Heng (DE); Joachim Uttinger, Kalchreuth (DE); Thomas Mann, Weissenohe (DE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 10/355,293

(22) Filed: Jan. 31, 2003

(65) Prior Publication Data

US 2003/0141098 A1 Jul. 31, 2003

(30) Foreign Application Priority Data

Jan. 31, 2002 (DE) ..... 102 03 900

(51) Int. Cl.[7] ..... H01B 7/00
(52) U.S. Cl. ..... 174/122 G; 174/124 R
(58) Field of Search ..... 174/121 A, 121 R, 174/122 R, 124 R, 122 G

(56) References Cited

U.S. PATENT DOCUMENTS

| | | | | | |
|---|---|---|---|---|---|
| 2,390,039 | A | * | 11/1945 | Slayter et al. | 174/121 SR |
| 3,325,590 | A | * | 6/1967 | Westervelt et al. | 174/121 R |
| 3,566,009 | A | * | 2/1971 | Lamond et al. | 174/116 |
| 3,602,636 | A | | 8/1971 | Evans | |
| 4,761,520 | A | * | 8/1988 | Wade et al. | 174/121 R |
| 5,008,495 | A | * | 4/1991 | Mudgett | 174/121 R |
| 5,061,823 | A | * | 10/1991 | Carroll | 174/105 R |
| 5,434,353 | A | * | 7/1995 | Kraus | 174/15.6 |
| 5,468,915 | A | * | 11/1995 | Green | 174/124 R |
| 2002/0046871 | A1 | * | 4/2002 | Goeblmaier et al. | 174/121 A |

FOREIGN PATENT DOCUMENTS

| | | | |
|---|---|---|---|
| DE | 8716166 | U1 | 3/1988 |
| DE | 3833597 | A1 | 4/1990 |
| DE | 4132390 | C2 | 4/1993 |
| DE | 4323229 | C2 | 1/1995 |
| DE | 69512242 | T2 | 2/1996 |
| DE | 69211067 | T2 | 5/1996 |
| DE | 19517392 | A1 | 11/1996 |
| DE | 69408369 | T2 | 2/1998 |
| DE | 20000917 | U1 | 7/2000 |
| DE | 10051962 | A1 | 5/2002 |
| EP | 0106708 | B1 | 4/1984 |
| GB | 2050041 | A | 12/1980 |

* cited by examiner

*Primary Examiner*—Chau N. Nguyen
(74) *Attorney, Agent, or Firm*—Sughrue Mion, PLLC

(57) ABSTRACT

The invention relates to an electrical line (L) having at least one electrical conductor (1) enclosed by temperature-resistant insulation (2) which ensures the functionality of the line (1) in case of fire. To minimize the fire load of the line (1), the insulation (2) comprises at least one multifilament thread (3) made of glass which is wound around the conductor (1) and whose windings are contiguous so as to create a completely closed sleeve (4) for the conductor (1). A thin protective layer (5) of a halogen-free, temperature-resistant insulation material is applied all over the sleeve (4).

16 Claims, 2 Drawing Sheets

ELECTRICAL LINE

BACKGROUND OF THE INVENTION

This application is based on and claims the benefit of German Patent Application No. 10203900.3 filed Jan. 31, 2003, which is incorporated by reference herein.

The invention relates to an electrical line having at least one electrical conductor enclosed by temperature-resistant insulation which ensures the functionality of the line in case of fire (European Patent 0 106 708 B1).

Such lines or cables are used as power lines or as information or data transmission lines, for example. The conductors of same (at least one conductor) are insulated with a specialized material which in case of fire ensures the functionality of a corresponding line for a specified time period. The power supply to machines, apparatus, and equipment is maintained during this time period, and information can be transmitted during this time as well. The time period should be long enough so that, for example, all persons present in a building can be notified and the lighting in the building remains on until the persons have left the building, and materials have been moved to a safe place, if necessary. The time period which can be preset by the user is from 30 minutes to 3 hours, for example.

In the known line according to aforementioned European Patent 0 106 708 B1, an insulation material is used which comprises a mica band, a layer made of polytetrafluoroethylene (PTFE), and a glass fabric coated with PTFE. The PTFE can resist temperatures of up to approximately 600° C. At higher temperatures the PTFE disintegrates into ash. A line insulated in this manner has a high fire load, which in many cases is unacceptable. In a fire, the line produces toxic and chemically corrosive gases (smoke) on account of the fluorine, which can attack and destroy metals and electrical or electronic circuits.

SUMMARY OF THE INVENTION

The object of the invention is to improve the aforementioned line so that its functionality is ensured with a greatly reduced fire load and without the danger of consequential damage.

This object is achieved by the invention by the fact that

- the insulation comprises at least one multifilament thread made of glass which is wound around the conductor and whose windings are contiguous so as to create a completely closed sleeve for the conductor, and
- a thin protective layer of a halogen-free, temperature-resistant insulation material is applied all over the sleeve.

Since the protective layer which serves primarily as a mechanical support for the windings of the multifilament thread can be designed using a small amount of material, the fire load of this line is reduced to essentially zero. In addition, the material of the protective layer is free of halogen-containing substances, so that in case of fire no gases can be produced which are harmful to the environment. The protective layer can also be used to apply identification marks on the particular line. The insulated line is very simple to design and manufacture, and is easily assembled due to the fact that the multifilament thread can be removed in any desired length from the conductor simply by pulling in the axial direction. Because of the basically adequate sleeve made of multifilament thread as a single layer of insulation, the line has small dimensions, so that the material used for additional layers can be reduced when the line is combined with at least one additional line in a cable.

BRIEF DESCRIPTION OF THE DRAWINGS

One exemplary embodiment of the subject of the invention is illustrated in the drawings.

DETAILED DESCRIPTION OF THE INVENTION

Figure 1:
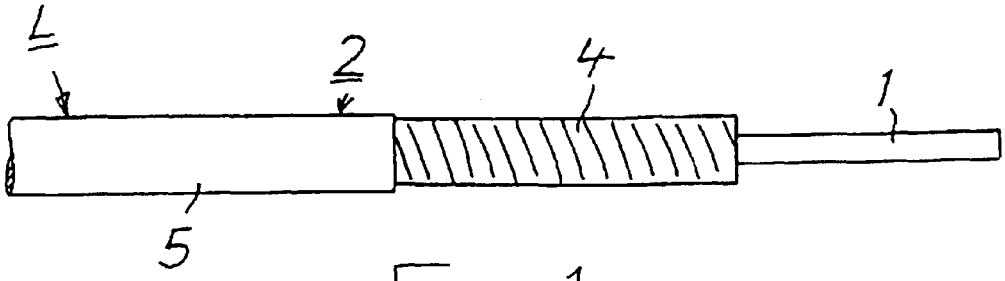
FIG. 1 shows in a schematic illustration a side view of a line according to the invention, with partially removed layers.
Figure 2:
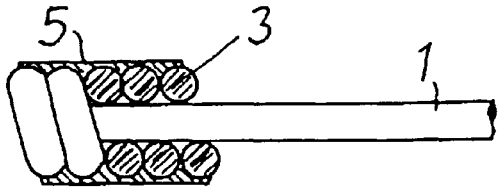
FIG. 2 shows a section from FIG. 1 in an enlarged view.
Figure 3:
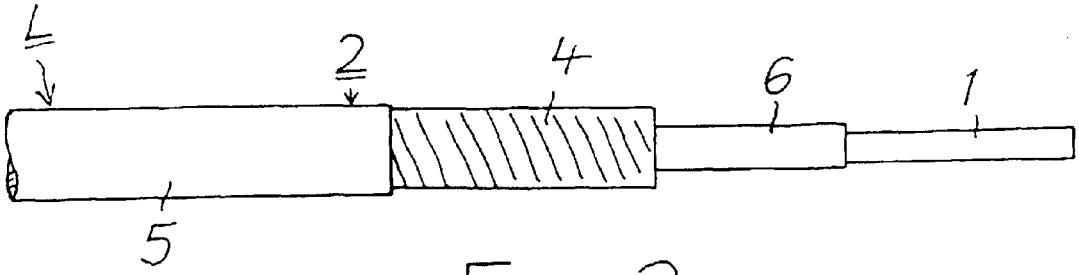
FIG. 3 shows an embodiment of the line supplemented in comparison to FIG. 1.
Figure 4:
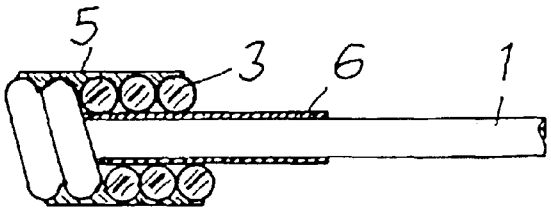
FIG. 4 shows a section from FIG. 3 in an enlarged view.

The electrical line illustrated in FIG. 1 comprises an electrical conductor 1 and insulation 2 enclosing the same. Conductor 1 may be a solid conductor or a stranded conductor. The conductor is preferably made of copper. Insulation 2 has a multifilament thread 3 made of glass which is wound around conductor 1 with contiguous windings, resulting in a sleeve 4 made of glass which is closed all around. Multifilament thread 3 may be wound, for example, with a pitch (length of lay) between 0.4 mm and 0.8 mm. A very thin protective layer 5 made of a halogen-free, temperature-resistant insulation material lies over sleeve 4. The protective layer basically serves to hold the windings of multifilament thread 3 together, but can also be used for applying identification marks. The layer thickness of protective layer 5 is preferably between 100 $\mu$m and 300 $\mu$m.

In one preferred embodiment, multifilament thread 3 is made of quartz glass. However, E-glass or S-glass, for example, could also be used. The multifilament thread has a large number of very thin, hair-fine glass filaments that are twisted together. Between 1000 and 6000 such glass filaments, for example, may be twisted together in a multifilament thread 3. In one preferred embodiment, the diameter of multifilament thread 3 is between 300 $\mu$m and 600 $\mu$m. The hair-fine filaments are approximately 6 $\mu$m to 12 $\mu$m thick. A multifilament thread 3 designed in this way can also be bent about very small radii without the risk of damage.

Protective layer 5 can be made, for example, from crosslinkable, ceramized silicone which is placed in a bath, through which conductor 1 provided with sleeve 4 is drawn. Excess material can be removed using a stripping nipple through which conductor 1 is pulled after leaving the bath. For protective layer 5, ceramic material which adheres to sleeve 4 may be used, which is applied in powder form, glued to sleeve 4, and likewise sized using a stripping nipple. In both embodiments, protective layer 5 is then crosslinked. In one preferred embodiment, this may be carried out by irradiation with light in the infrared region.

Protective layer 5 may also be applied to sleeve 4 as a film made of polyimide, or polyether ether ketone (PEEK), for example. The particular film can preferably be wound in an overlapping fashion onto sleeve 4 of conductor 1. The film is coated on the side contacting sleeve 4, using a heat-activated adhesive. Moisture-proof adhesion of the film to sleeve 4 may be achieved by subsequent heat treatment.

When line L is to be used for high-temperature applications, first a band 6 made of mica around which multifilament thread 3 is wound can be placed on conductor 1. Band 6 may be molded around conductor 1, running lengthwise in an overlapping fashion, or may be wound around the conductor in an overlapping fashion. The band is approximately 0.1 mm thick.

Figure 5:
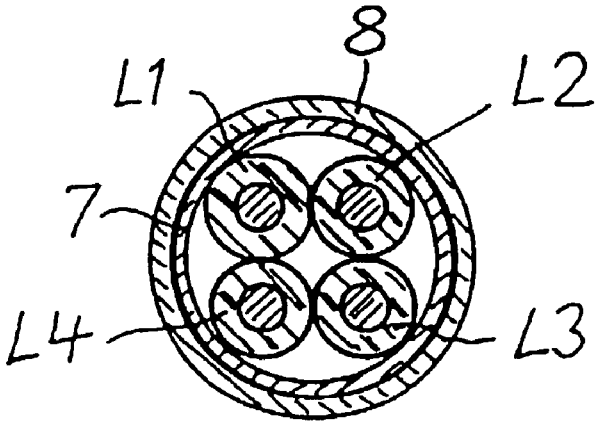
FIG. 5 shows a cross section through a cable having multiple lines.

The line described with reference to FIGS. 1 through 4 may also be combined with at least one additional line to form a cable. An example of such a cable is illustrated in cross section in FIG. 5. The cable has four lines L1 through L4, which may be designed according to the embodiments shown in FIGS. 1 through 4. Lines L1 through L4 are stranded together, preferably with alternating directions of lay (SZ stranding). The lines may be stranded as a star-quad, as used in telecommunications and data cables.

A layer 7 made of a glass fabric band or a glass/mica band may be laid over the cable core formed by lines L1 through L4, and over this layer an electrically effective shield 8 may be laid. The band for layer 7 can be approximately 100 $\mu$m thick. In one preferred embodiment, the band is wound around the cable core in an overlapping manner. Resulting layer 7 acts as a fireproof layer, and in case of fire ensures that the insulating distance is maintained between conductors 1 of the cable core and shield 8. As shield 8, a copper foil or aluminum foil may be used which is molded around the cable core, running lengthwise in an overlapping fashion, or wound around the cable core in an overlapping fashion.

The particular film can be approximately 75 $\mu$m thick. For a moisture-proof cable design, the foil can be coated on one side with a heat-activated adhesive so that shield 8 adheres to insulating layer 7 after heating. Shield 8 may also be designed as a longitudinally welded, corrugated copper tube. The troughs of the copper tube are preferably filled in to produce a smooth exterior surface. A glass or ceramic yarn, for example, may be used for this purpose.

Figure 6:
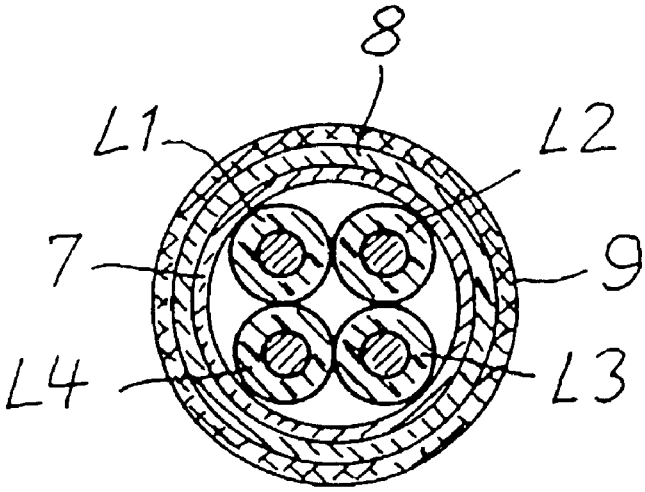
FIG. 6 shows an embodiment of a cable supplemented in comparison to FIG. 5.

For additional mechanical protection, braiding 9 made of stainless steel wires may be placed over shield 8, as shown in FIG. 6. For this purpose, galvanized steel wires or stainless steel wires, for example, may be used. The wires can have a diameter between 100 $\mu$m and 300 $\mu$m. Braiding 9 should have an optical covering between 80% and 97%. The braiding is not flammable, and ensures good mechanical stability, even in a fire, in particular under tensile and pressure loads. Braiding 9 has direct contact with shield 8, so that no unwanted electrical loops can appear.

A cable that can be used as a communications cable in the electronics industry has the following construction, for example, according to FIG. 6:

The cable has four lines L1 through L4 stranded together in its cable core according to the invention. The lines may be stranded as a star-quad. Each line L1 through L4 has a conductor 1 with a diameter of 0.8 mm, made of copper. A mica band 6 is laid over each conductor, and around the band a multifilament thread 3 made of quartz glass having a pitch of approximately 0.4 mm is wound. Each multifilament thread 3 is enclosed by a 200 $\mu$m-thick protective layer 5 made of crosslinked, ceramized silicone. Protective layers 5 for the four lines L1 through L4 have different identification marks. The cable core formed from the four lines L1 through L4 stranded together has a diameter of approximately 5.3 mm. The cable core is enclosed by a wound band, made of glass fabric or glass/mica, which is approximately 100 $\mu$m thick. An electrical shield 8 made of a copper foil approximately 75 $\mu$m thick is laid over layer 7 thus formed, and the shield adheres to layer 7 following heat treatment. As mechanical protection, braiding 9 made of chromium/nickel steel wires, for example, having an optical covering greater than 90% is laid over shield 8 in direct contact with same. The finished cable has a diameter of approximately 6.5 mm.

What is claimed is:

1. An electrical line having at least one electrical conductor enclosed by temperature-resistant insulation which ensures the functionality of the line in case of fire, characterized in that the insulation comprises at least one multifilament thread made of glass having between 1000 and 6000 hair-fine filaments which is wound around the conductor and whose windings are contiguous so as to create a completely closed sleeve for the conductor, and said line includes a protective layer of a halogen-free, temperature-resistant insulation material encasing the sleeve, wherein the protective layer is made of crosslinked, ceramized silicone.

2. A line according to claim 1, characterized in that the multifilament thread is made of quartz glass.

3. A cable having at least two lines situated in a cable core according to claim 2, characterized in that a layer formed from a glass fabric ribbon or a glass/mica ribbon is placed over the lines so as to mutually enclose said lines, and the layer is enclosed by an electrically effective shield.

4. A line according to claim 1, characterized in that the wall thickness of the protective layer is equal to or less than 300 $\mu$m.

5. A cable having at least two lines situated in a cable core according to claim 4, characterized in that a layer formed from a glass fabric ribbon or a glass/mica ribbon is placed over the lines so as to mutually enclose said lines, and the layer is enclosed by an electrically effective shield.

6. A line according to claim 1, characterized in that first a ribbon made of mica is formed around the conductor, and around this ribbon the multifilament thread is wound.

7. A line according to claim 6, characterized in that the ribbon made of mica is formed around the conductor, running lengthwise in an overlapping fashion.

8. A cable having at least two lines situated in a cable core according to claim 7, characterized in that a layer formed from a glass fabric ribbon or a glass/mica ribbon is placed over the lines so as to mutually enclose said lines, and the layer is enclosed by an electrically effective shield.

9. A line according to claim 6, characterized in that the ribbon made of mica is wound around the conductor in an overlapping fashion.

10. A cable having at least two lines situated in a cable core according to claim 9, characterized in that a layer formed from a glass fabric ribbon or a glass/mica ribbon is placed over the lines so as to mutually enclose said lines, and the layer is enclosed by an electrically effective shield.

11. A cable having at least two lines situated in a cable core according to claim 6, characterized in that a layer formed from a glass fabric ribbon or a glass/mica ribbon is placed over the lines so as to mutually enclose said lines, and the layer is enclosed by an electrically effective shield.

12. A cable having at least two lines situated in a cable core according to claim 1, characterized in that a layer formed from a glass fabric ribbon or a glass/mica ribbon is placed over the lines so as to mutually enclose said lines, and the layer is enclosed by an electrically effective shield.

13. A cable according to claim 12, characterized in that the shield is made of a foil of copper or aluminum.

14. Cable according to claim 13, characterized in that the foil on the side facing the layer which encloses the cable core in the finished cable is coated with a heat-activated adhesive.

15. A cable according to claim 12, characterized in that a braiding made of stainless steel wires is placed over the shield, in direct contact with the shield.

16. A cable according to claim 15, characterized in that the braiding has an optical covering between 80% and 97%.

* * * * *